US005158663A

United States Patent [19]

Yahalom

[11] Patent Number: 5,158,663

[45] Date of Patent: Oct. 27, 1992

[54] PROTECTIVE COATINGS FOR METAL PARTS TO BE USED AT HIGH TEMPERATURES

[76] Inventor: Joseph Yahalom, 19 Antwerpen Street, Haifa 34980, Israel

[21] Appl. No.: 783,023

[22] Filed: Oct. 25, 1991

[30] Foreign Application Priority Data

Aug. 12, 1991 [IL] Israel ..... 099216

[51] Int. Cl.[5] ..... C25D 11/12; C25D 11/34

[52] U.S. Cl. ..... 205/50; 205/171; 205/175; 205/224; 205/229; 205/917

[58] Field of Search ..... 204/37.1, 42; 205/50, 205/171, 175, 224, 229, 917; 428/472.2

[56] References Cited

U.S. PATENT DOCUMENTS 3,551,303 12/1970 Suzuki et al. ..... 204/35
3,666,638 5/1972 Harris ..... 205/175
3,864,220 2/1975 Denning ..... 204/37.1
4,039,400 8/1977 Hayfield ..... 204/38.1
4,052,273 10/1977 Aronson et al. ..... 204/37.1
4,481,083 11/1984 Ball et al. ..... 204/38.3
4,481,084 11/1984 Chen et al. ..... 204/42
4,781,802 11/1988 Fresia ..... 204/37.1

*Primary Examiner*—Donald R. Valentine
*Assistant Examiner*—William T. Leader
*Attorney, Agent, or Firm*—Browdy and Neimark

[57] ABSTRACT

A method for producing protecting layers on a metal selected from aluminum, titanium and zirconium, or alloys thereof, involves at least two anodic oxidation steps producing oxide layers and a thermal treatment which is carried out before the last anodic oxidation step. The treated metal according to the invention is protected even at high temperatures and under conditions of thermal cycling.

14 Claims, 4 Drawing Sheets

PROTECTIVE COATINGS FOR METAL PARTS TO BE USED AT HIGH TEMPERATURES

FIELD OF THE INVENTION

The present invention relates to a method for protecting the surface of a metal which is capable of being anodically oxidized. More particularly the invention relates to a method for protecting the surface of a metal selected from the group consisting of aluminum, titanium and zirconium, or alloys thereof, by producing an insulating layer.

BACKGROUND OF THE INVENTION

It is well known that inadequate protection of active metals such as aluminum, titanium or zirconium may finally result in rapid corrosion which will tend to be local and penetrating if protective surface coatings are cracked in service due to high temperatures.

In semiconductor fabrication technology, as well as in other areas of technology, surface layers are often used to coat the surface of construction parts made of metal in order to protect them against corrosion or to impart desirable properties such as: insulating and dielectric properties, as well as surface hardness.

A particularly convenient type of surface layer for such applications is a layer of oxide of the metal to be protected, produced by the oxidation of the metal surface. The oxidation can be done chemically by immersion of the respective metal in an oxidizing medium, or electrochemically by the method known as anodic oxidation, or anodization. In the method of anodic oxidation the metal to be coated is immersed in a bath of an electrolyte and connected to the positive pole of an external direct current source. The negative pole is connected to an auxiliary electrode immersed in the same bath The structure of the oxide film produced on the surface by anodic oxidation depends on the metal, the nature of the electrolyte, its concentration and temperature, and on the voltage applied.

In most applications, for anodic oxidation of aluminum, the electrolyte used is acidic, usually sulfuric acid, but other acids such as chromic acid, phosphoric acid or lactic acid are also often being used. When acidic electrolytes ar used for aluminum, the resulting oxide is porous. The pores are known to be perpendicular to the metal surface. Each pore is separated from the metal by a thin compact oxide layer usually called the "barrier layer". The distance between pores, their diameter, and the thickness of the barrier layer are determined by the applied voltage, acid type and concentration, and temperature. Generally, the lower the temperature and concentration, and the higher the voltage, the narrower and less abundant are the resulting pores. The mechanical properties of such oxides are thus enhanced. In order to increase the corrosion resistance of porous anodic oxide films, the pores are often sealed by a subsequent treatment, the simplest one being immersion in boiling water which causes the oxide to increase its volume by hydration.

For special applications using aluminum, such as when barrier type films are required, neutral electrolytes are used. Typical electrolytes are aqueous solutions of compounds such as ammonium citrate, ammonium tartrate, etc. The oxides formed in neutral electrolytes are compact and non-porous. Furthermore, the oxides formed by any type of bath on a number of anodically oxidizable metals other than aluminum are also compact and nonporous.

The use of oxide films produced by the known anodic oxidation techniques for corrosion protection of the metal, is limited to low temperatures. When the oxidized metal is subjected to an elevated temperature, the oxide layer typically cracks by tensile stresses which are due to the difference in the expansion coefficient between the metal and the oxide (e.g., $5\times10^{-6}/°$ C. for aluminum oxide, and $25\times10^{-6}/°$ C. for aluminum metal). Such cracks create a pathway for the corrosive environment to attack the underlying bare metal, thereby permitting penetrating corrosion to occur which can result in structural damage to the part and loss of adhesion and flaking of the oxide layer. Additionally, any water used to seal porous anodic films is evaporated at such temperatures and the films return to being susceptible to damage by corrosive environments.

The problems of corrosion have been greatly intensified in the last forty years by developments in jet engines, nuclear energy and computer manufacturing. Elevated temperatures are very common in fabrication chambers in the semiconductor and other industries, combined with extremely corrosive environments such as fluorinated gas in Chemical Vapor Deposition (CVD) chambers, for example, or in hot parts of aircraft engines and external parts of aircraft subject to high flying velocities. In certain types of equipment associated with nuclear reactors, not only are metals exposed to corrosive chemicals and elevated temperatures, but the nuclear reactor metals are subjected to hydrogen and deuterium which may induce changes in the physical properties of the metal, such as ductility.

The known anodization processes are therefore incapable of affording protection under such conditions. Frequent failures are thus encountered in critical parts of such equipment, particularly when operating at high temperatures of several hundred degrees centigrade, and rapid loss of metal occurs by corrosion. This, in turn, results in the need for frequent replacement of parts, loss of production time and contamination of electronic microcircuitry with particles of corrosion products. In supersonic aircraft, even melting of the metal may result due to loss of the insulating oxide coating by thermal cracking.

The above brief review of the problem clearly indicates the need for an improved method to obtain adequate protection of a metal by an oxide layer which persists for prolonged periods of time even after use at high temperatures.

U.S. Pat. No. 3,551,303 to Suzuki et al relates t method for forming anodic oxide film on aluminum or an aluminum alloy for the purpose of electrical insulation. The problem being solved by the Suzuki et al patent is different from the problem being addressed by the present invention. The Suzuki et al patent addresses the problem that the anodic oxide film has little flexibility and cracks on elongation of the surface by only 0.4–5%, such as being subjected to bending. When subjected to such tensile stress, the cracks which are formed reduce the insulating property of the film if their aperture is too wide. There is no problem of the film actually falling off of the aluminum, as the patent indicates that the adhesive property of the film is excellent. The only disadvantage is that the breakdown voltage of the film becomes lower when the conductor is bent with a radius of curvature not larger than about 20 times as large as the diameter or thickness of the conductor. This problem is solved in the invention of the Suzuki et al. patent by first forming the anodic oxide film on the surface of the aluminum or aluminum alloy at a thickness smaller than the thickness of the desired final film. Then cracks are intentionally formed over the region of the anodic oxide film by elongating the film or by subjecting the conductor having the anodic oxide film to a rapid temperature change, and using the difference between the thermal expansion coefficient of aluminum or aluminum alloy and that of the anodic oxide film for formation of the cracks. The specific extent of heat treatment is nowhere disclosed. Following intentional crack formation, anodic oxidation is again carried out so as to increase the thickness of the anodic oxide film above the thickness at the time of the original crack formation. According to the method of Suzuki et al., the previously formed cracks extend to the metal through the thick oxide film during bending in service in the larger numbers and the narrower aperture typical of those formed in thin oxides.

U.S. Pat. No. 4,052,273 to Aronson et al. discloses a method of anodizing porous sintered tantalum material, suitable for making a porous tantalum capacitor pellet or slug having decreased current leakage. After such a pellet is anodized at a maximum predetermined desired voltage, it is removed from the anodizing bath and heated to a temperature of between 150°-300° C. for at least three minutes, and then returned to the anodizing bath and subjected to more electrical current. The heating and reanodizing steps may be repeated. The sole purpose of this heat treatment is to decrease the current leakage of the capacitor anode. U.S. Pat. No. 4,781,802 to Fresia discloses a similar method.

Japanese patent 60/033,393 discloses a method for electrolytically coloring aluminum or aluminum alloy by anodically electrolyzing the aluminum or aluminum alloy in a phosphoric acid solution to form an anodic oxidation layer, electrolyzing in an aqueous electrolyte containing metal salt with an alternating current, heat treating at 300°-400° C., dipping in a phosphoric acid bath to rapidly cool the aluminum or aluminum alloy to room temperature, and then anodically electrolyzing in a phosphoric acid solution. The sole purpose of the method is to provide a unique coloring effect.

U.S. Pat. No. 3,864,220 to Denning et al discloses a method for reducing hydrogen embrittlement of nuclear reactor structural parts made of zirconium or zirconium alloy. The part is first surface anodized and then subjected to heat treatment in an oxidizing atmosphere. There is no subsequent re-anodization step.

SUMMARY OF THE INVENTION

It is an object of the present invention to solve the problems of the prior art.

It is a further object of the present invention to provide an improved method to obtain adequate protection from corrosion or hydrogen embrittlement of a metal by an oxide layer which persists for prolonged periods of time, even after use at high temperatures.

It is a further object of the present invention to provide a method for fabricating a part having a porous aluminum oxide layer which is protected from corrosion, even at high temperatures and under conditions of thermal cycling.

It is yet another object of the present invention to provide protection of a metal, such as aluminum, titanium or zirconium, by means of a compact, non-porous, oxide layer, optionally under a thick porous layer in the case of aluminum, which protects the metal at high temperatures and under conditions of thermal cycling.

It is still a further object of the present invention to provide a metal part having such an improved anodic oxidation layer thereon.

These and other objects of the present invention will be better understood from the following summary of the invention, the description of the drawings and the detailed description of preferred embodiments.

The present invention consists of a method for fabricating parts of an anodizable metal (hereinafter "metal"), and preferably a metal selected from aluminum, titanium and zirconium or alloys thereof, on which at least two distinct oxidation treatments are applied by an anodic oxidation technique, a thermal treatment being applied between such oxidation steps. The thermal treatment should be carried out at a temperature which is at least as great as that at which the respective metal part is to be used in service, such temperature being sufficient to cause cracks in the oxide layer, preferably greater than 250° C. It has been found that by using this method, the peeling of such layers during subsequent thermal cycling in service is completely eliminated and any corrosion which would otherwise occur through the cracks is prevented. The thermal treatment on the first oxide layer induces the formation of cracks in the oxide. The additional oxidation step blocks the bottom of the cracks by new oxide and creates anchoring roots between the oxide and the metal surface. Under certain preselected circumstances, the barrier layer over the whole surface of the metal under the porous oxide film may be thickened, in the case of aluminum, and thus further enhanced corrosion resistance is achieved. The thickening step preferably occurs before the first heat treatment but may take place at any time prior to the last heat treatment which precedes the final anodization step.

Experiments with aluminum susceptors obtained by this method have been found in practice to withstand the corrosive environment in tungsten C.V.D. chambers at 475° C. several times longer than susceptors coated by conventional anodizing.

In a preferred embodiment, the metal part is subjected twice to anodic oxidation, each time followed by a thermal treatment, and finally again subjected to anodic oxidation.

The anodization operation may be carried out either in an acidic bath, neutral bath or alkaline bath, the techniques of each of which are known in the art. It has been found that when the metal is aluminum and the initial bath is acidic, the performance of the final anodization step in a neutral bath produces a more compact oxide, which is desirable and is thus preferred.

DETAILED DESCRIPTION OF THE INVENTION

In order to obtain the optimum results using the present invention, producing highly uniform and protecting oxide coatings with the desired resistance to thermal cycling, it is required to control carefully the anodic oxidation cycles as well as the thermal treatment step.

Figure 1:
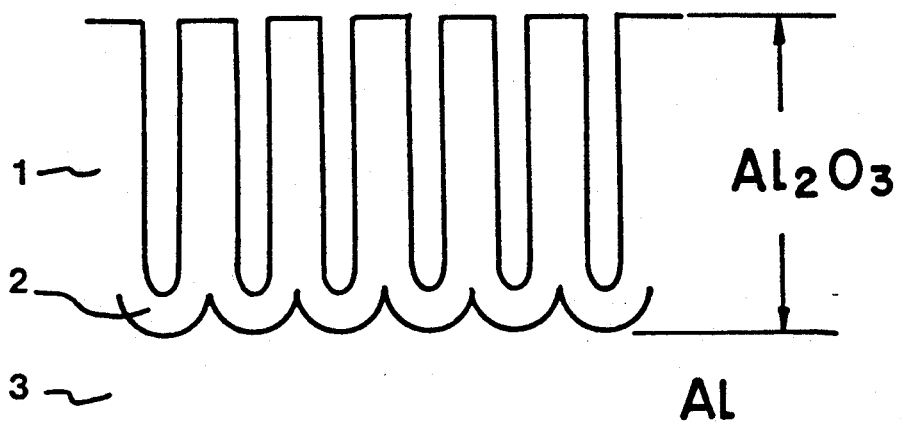
FIG. 1 illustrates schematically an anodic oxide coating as formed on aluminum in an acidic medium, with a porous layer (1) on top of a barrier layer (2) formed at the interface with the metal (3).

As shown in FIG. 1, when an aluminum substrate is subjected to anodic oxidation in an acidic medium, a porous surface layer 1 of aluminum oxide is formed with a barrier layer 2 between the pores and the surface of the unoxidized aluminum. The pores may have a depth on the order of 10 microns, with the barrier layer having a thickness on the order of 0.02 microns.

In some cases, where serious corrosion conditions are prevailing, more than two anodizing steps may be carried out, the heat treatment being carried out after each anodizing step, followed by an additional anodizing step.

Figure 2:
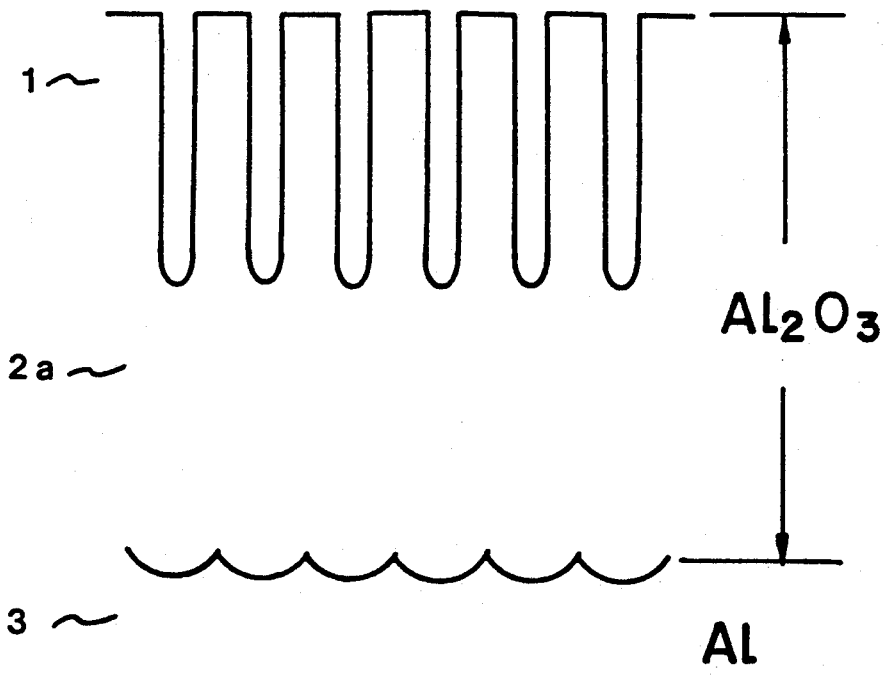
FIG. 2 illustrates schematically the same coating after a secondary anodic oxide layer is formed in a neutral solution, causing the barrier layer to thicken.
Figure 3:
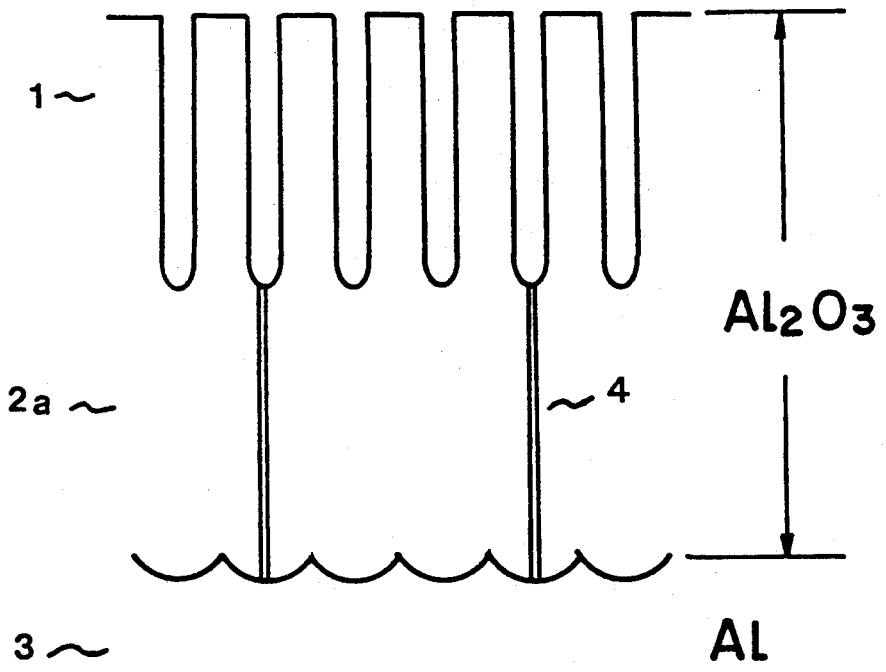
FIG. 3 illustrates schematically the appearance of induced cracks in the oxide layer after a heat treatment at 450° C.
Figure 4:
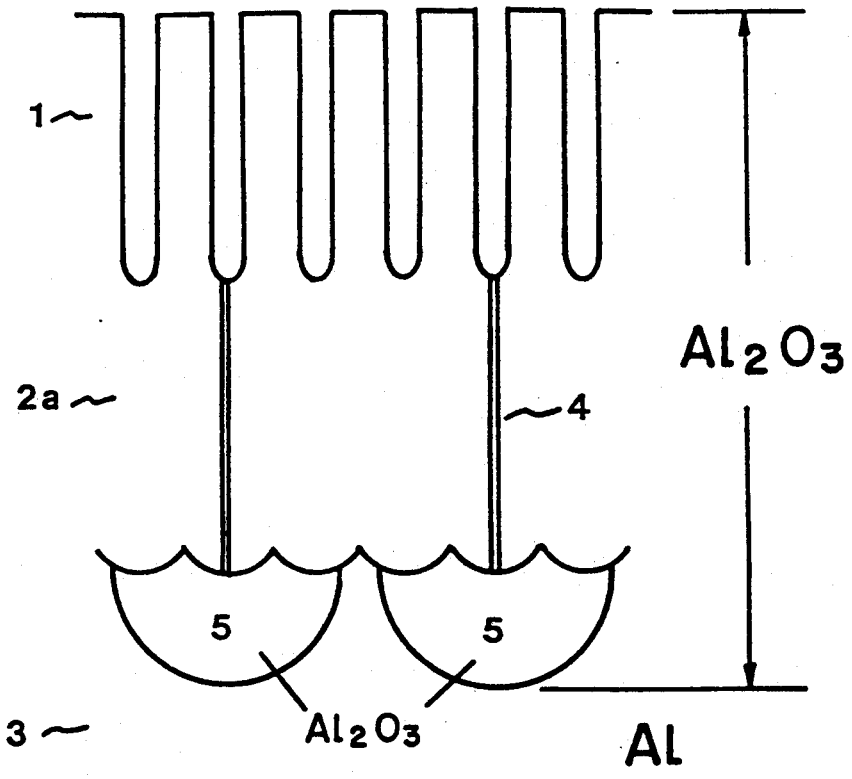
FIG. 4 illustrates schematically, the surface of the metal after the thermal treatment and the blocking of the bottom of the induced cracks with the formation of a new anodic oxide in a neutral medium, and the formation of anchoring oxide roots into the metal.

There are cases when several anodizing steps are used and one single heat treatment will be sufficient. In these cases the heat treatment should be carried out prior to the last anodizing step which has to block the cracks induced by such heat treatment. This embodiment is illustrated in FIGS. 2–4. In FIG. 2, the anodized surface shown in FIG. 1 has been subjected to a second anodization treatment in order to increase the thickness of the barrier layer. It is known that by means of a second anodization treatment in a neutral medium, the barrier layer may be increased to a size of about 0.5 microns as shown as barrier layer 2*a* in FIG. 2. After heat treatment at a temperature at least as great as that to which the part is expected to be subjected in its ultimate use, cracks 4 are formed through the barrier layer 2*a*, as shown in FIG. 3. In actuality, the cracks will be fewer and farther between then as shown in FIG. 3. Upon further anodization conducted after the heat treatment, the bottoms of the induced cracks 4 are blocked by hemicylinders of anodic oxide 5 formed in the aluminum substrate 3. These hemicylinders 5 serve as anchors to root the oxide layer into the metal. Furthermore, upon subjecting the parts to corrosive conditions, no metal substrate is directly open to the corrosive environment by means of pores and cracks as all of such openings will have been blocked by the formed hemicylinders.

The embodiment shown at FIGS. 1–4 is a special case which applies only when a metal such as aluminum is used. When such a metal is used and the anodization bath is acidic, one obtains a porous oxide layer as shown in FIG. 1, and when that porous oxide layer is subjected to a further anodization under neutral conditions, one obtains a barrier layer of increased thickness as shown in FIG. 2. It is not necessary, however, to include the step of increasing the barrier layer by means of a second anodization in a neutral bath prior to heat treatment, as shown in FIG. 2. If the oxide film of FIG. 1 is subjected to heat treatment, then cracks will form in the barrier layer. If then subjected to anodization in a neutral bath, hemicylinders of compact oxide will form beneath the cracks to provide the anchoring and blocking effect. Similarly, if following heat treatment, the last anodization step is in an acidic medium, hemicylinders of additional porous aluminum oxide will form beneath the cracks to provide the anchoring and blocking effect.

When the metal is aluminum and the initial anodization bath is neutral, or when other anodizable metals are used under appropriate conditions, a compact, non-porous oxide film will be formed upon anodization. After heat treatment, the second anodization step, assuming that it takes place at a voltage not substantially higher than that of the initial anodization (preferably at the same or lower voltage), will not substantially increase the thickness of the oxide layer, but will form anchoring and blocking hemicylinders beneath the cracks, as the current will have direct access to the metal through the cracks.

It is possible to increase the thickness of the oxide layer by increasing the voltage in the last anodization step. However, there is no substantial advantage in doing so. Indeed, when increasing the thickness over the entire layer, the growth is essentially frontal and the cracks may re-occur in the new oxide. Thus, in the preferred embodiments of the present invention, there is no step of substantially increasing the thickness of the oxide layer, or of the barrier film, between the last heat treatment and the last anodization steps. Accordingly, any method claims of the present application "consisting essentially of" specified steps are hereby deemed to explicitly exclude any steps which may cause any substantial increase in the oxide layer between the last heat treatment step and the last anodization steps.

In preferred embodiments of the present invention, the invention excludes use of a porous metal substrate, with the end product being a capacitor anode, particularly when the metal is tantalum. The preferred purpose of the present invention is to prevent corrosion of metal parts in use in environments subjected to high temperatures, and/or under conditions of thermal cycling, or subjected to high doses of hydrogen or deuterium, such as in a nuclear reactor. When treated in accordance with the present invention, such parts have greatly improved corrosion resistance.

The present invention is further not intended to cover a method for electrically coloring aluminum, involving a step of electrolyzing in an aqueous electrolyte containing metal salt with an alternating current. Accordingly, method claims "consisting essentially of" specified steps are hereby explicitly intended to exclude any step of electrolyzing an aluminum or aluminum alloy which has an anodic oxidation layer in an electrolyte solution containing a metal salt with an alternating current.

U.S. Pat. No. 3,864,220 to Denning et al does not explain why heat treatment will reduce hydrogen pick-up other than to say that an oxide film is imparted to the surface of the part. However, an oxide film had already been imparted to the surface of the part by the anodization step. One of ordinary skill in the art reading the Denning et al patent would know of no reason to add another anodization step to the process of Denning et al. Furthermore, Denning et al discloses that the anodization followed by heat treatment only improves hydrogen pick-up by a factor of 185% (from 2.4 to 1.3). Example 7, hereinbelow, establishes that anodization followed by heat treatment and further anodization improves hydrogen pick-up over anodization alone (applied twice) by a factor of 2000% (100 ppm to 5 ppm).

The anodizing operation is carried out using either the technique of acidic, alkaline or neutral medium. The present invention is not directed to any given anodization medium, per se, but to a new use of such media in such a manner as to improve the protection afforded to the substrate. Any known media and anodization conditions may be used for each of the anodization steps of the present invention.

In case of acidic medium, the acid to be used is in most cases selected from sulfuric acid, oxalic acid, lactic acid, chromic acid, phosphoric acid and mixtures thereof. When using an acidic medium, the conditions of the operation are generally as follows:

concentration of the acid, in the range of between 10% to 20% by weight.

current density, in the range of between 10 to 50 mA/sq.cm.

temperature of the anoidizing bath, in the range of between −5° C. to 60° C.

In case of a neutral medium, the solution to be used is selected from known reagents as used in the art, such as ammonium citrate, ammonium tartrate, ammonium borate, etc. The conditions of the operation are generally as follows:

concentration of the solution, in the range of between 0.0001 M to 1 M.

current density, in the range of between 0.1 to 10 mA/sq.cm.

temperature of the anodizing bath, in the range of between 0° to 60° C.

Although the invention has been described in respect to aluminum, zirconium, and titanium, or alloys thereof, one may conceive to utilize successfully the method also with other metals or alloys which are capable of anodic oxidation.

The invention will be hereinafter illustrated by a number of Examples, it being understood that these Examples are presented only for a better understanding of the invention, without limiting its scope. A person skilled in the art after reading the present specification, will be in a position to insert changes or modifications, which should be considered as part of the invention which is limited only by the appended claims.

It should be pointed out that Examples 1 and 2 do not illustrate the invention and are presented only for comparison purposes to show the behavior of an aluminum plate which was not treated according to the present invention. The concentrations mentioned are weight percentage unless otherwise stated.

EXAMPLE 1

(for comparison purposes)

A plate of 6061 aluminum was anodized in a solution of 15% sulfuric acid at 25° C., with a current density of 20 mA/sq.cm for 30 minutes at 16 volts. The plate was tested in fluorine gas at 250° C. for 24 hours and it was found that it was severely attacked, being covered by a white powder.

EXAMPLE 2

(for comparison purposes)

An aluminum plate as in Example 1 was anodized in a solution of 0.01 M ammonium citrate at 22° C. with a current density of 1 mA/sq.cm to a final voltage of 200 volts attained after 25 minutes. The plate was tested in fluorine gas at 250° C. for 24 hours and it was found that it was severely attacked being covered by a white powder.

EXAMPLE 3

The experiment as in Example 1 was repeated carrying out the anodization operation under the same conditions.

The anodized plate was then heated at 300° C. for about 15 minutes and anodized again in a solution of 0.01 M ammonium citrate at 22° C. with a current density of 1 mA/sq.cm to a final voltage of 200 volts attained after 25 minutes.

The treated plate was tested in fluorine gas at 250° C. for 240 hours and no corrosion effects were noticed.

EXAMPLE 4

The experiment as in Example 1 was repeated carrying out the first anodization operation under the same conditions.

The anodized plate was then anodized again in a solution of 0.01 M ammonium citrate at 22° C. with a current density of 1 mA/sq.cm to a final voltage of 200 volts attained after 25 minutes.

The twice anodized aluminum plate was heated at 500° C. for about 15 minutes and anodized for the third time in a solution of ammonium citrate as in the second anodization step described above.

The resulting plate was tested at 480° C. for 240 hours in an environment of fluorine gas without any corrosion effects.

EXAMPLE 5

The experiment as described in Example 3 is repeated, but in this case the second step of anodization is carried out in a solution of 15% sulfuric acid at 22° C. under the same conditions as in the first anodization step.

When the resulting treated plate is tested in fluorine gas at 250° C., no corrosion effects are noticed.

EXAMPLE 6

The experiment as in Example 2 was repeated carrying out the anodization operation under the same conditions. The anodized plate was then heated at 300° for about 15 minutes and anodized again in 0.01 M ammonium citrate up to 200 volts.

The plate was tested in fluorine gas at 250° C. for 240 hours and no corrosion effects were noticed.

EXAMPLE 7

A zirconium tube was anodized for one hour at 25° C. in a solution containing: 47% ethanol, 25% water, 15% glycerin, 8% lactic acid (85%), 4% phosphoric acid (85%) and 1% citric acid (all percentages being by volume) at 250 V.

The tube with the resulting oxide layer was heated at 450° C. in air and further reanodized using the same conditions as in the first anodizing operation.

The resulting tube was tested in an autoclave containing pure water at 400° C. and a pressure of 10 MPa for 14 days. It was found to contain less than 5 parts per million hydrogen.

In a comparative experiment, without any heat treatment operation prior to the final anodization, but with the same two anodizing steps, it was found that the tube contained 100 parts per million hydrogen.

EXAMPLE 8

A titanium specimen plate was anodized in an aqueous solution of 0.1 M sodium sulfate at a current density of 12.5 mA/sq.cm for 3 minutes at 29° C. The voltage reached 140 volts during the operation.

The resulting plate was heated to 400° C. for 30 minutes and subsequently reanodized using a bath with the same composition and same conditions as in the first oxide layer.

It was found that the oxide coating remained adherent to the metal during thermal cycling between 25° and 380° c. In an experiment with a similar plate but without the intermediate heat treatment, the oxide layer appeared as flakes and peeled off.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

I claim:

1. A method for providing a protective surface layer on a machine part made of a metal capable of anodic surface oxidation to protect such metal part from corrosive conditions, consisting essentially of the steps of:

(a) oxidizing by anodic oxidation the surface of said metal part to form a surface layer of an oxide of the metal to be protected;

(b) thermally treating the part at a temperature which is at least equal to the highest temperature to which the metal part is intended to be subjected during use, said treating temperature being at least 250° C. and being sufficient to cause cracks to form in the formed oxide surface layer, thereby exposing the metal to be protected; and (c) subjecting the anodized and heat treated surface of the part to another anodic oxidation step under conditions whereby an oxide of the metal to be protected will be formed mainly in the regions where the metal is exposed, the additional oxide serving to anchor the oxide surface layer to the metal and to block the cracks by forming additional oxidation below said cracks so that no metal is exposed.

2. A method in accordance with claim 1, further including the steps of repeating steps (b) and (c) at least once.

3. A method according to claim 1, wherein said metal is selected from the group consisting of aluminum, titanium, zirconium, and alloys thereof.

4. A method according to claim 1, wherein said step (a) is carried out in an acidic medium.

5. A method according to claim 4, wherein said acidic medium is selected from the group consisting of sulfuric acid, phosphoric acid, lactic acid, oxalic acid, chromic acid and mixtures thereof.

6. A method according to claim 1, wherein said step (a) is carried out in a neutral or alkaline medium.

7. A method according to claim 1, wherein said metal is aluminum or an aluminum alloy capable of anodic surface oxidation.

8. A method according to claim 1, wherein said metal is titanium, zirconium, or an alloy thereof capable of anodic surface oxidation.

9. A protected metal machine part produced by the process of claim 1.

10. A method for providing a protective surface layer on a part of aluminum or an aluminum alloy capable of anodic surface oxidation to protect such metal part from corrosive conditions, comprising the steps of:

(a) oxidizing the surface of said aluminum or aluminum alloy part by anodic oxidation in an acidic medium so as to form a porous oxidized surface layer with a barrier layer between the pores and the aluminum or aluminum alloy;

(b) oxidizing the part resulting from step (a) by anodic oxidation in a neutral medium so as to increase the thickness of the barrier layer;

(c) thermally treating the part at a temperature which is at least equal to the highest temperature to which the metal part is intended to be subjected during use said treating temperature being at least 250° C. and being sufficient to cause cracks to form int he formed oxide surface layer, thereby exposing the metal to be protected; and (d) subjecting the anodized and heat treated surface of the part to another anodic oxidation step under conditions whereby an oxide of the metal to be protected will be formed mainly in the regions where the metal is exposed, the additional oxide serving to anchor the oxide surface layer to the metal so as to block said cracks by forming additional oxidation below said cracks so that no metal is exposed.

11. A protected aluminum or aluminum alloy part produced by the process of claim 9.

12. A method in accordance with claim 10, further including the steps of repeating said steps (c) and (d) at least once.

13. A protected aluminum or aluminum alloy part produced by the process of claim 10.

14. In a method which includes anodizing the surface of a machine part made of a metal capable of anodic surface oxidation to protect the metal machine part from corrosive conditions and subjecting said machine part to corrosive conditions at temperatures above about 250° C., the improvement wherein said anodizing step comprises:

(a) oxidizing by anodic oxidation the surface of said metal part to form a surface layer of an oxide of the metal to be protected;

(b) thermally treating the part at a temperature which is at least equal to the highest temperature to which the part is to be subjected in said subjecting step, said temperature being sufficient to cause cracks to form in the formed oxide surface layer, thereby exposing the metal to be protected; and (c) subjecting the anodized and heat treated surface of the part to another anodic oxidation step under conditions whereby an oxide of the metal to be protected will be formed mainly in the regions where the metal is exposed, the additional oxide serving to anchor the oxide surface layer to the metal and to block the cracks by forming additional oxidation below said cracks so that no metal is exposed.

* * * * *